US008881940B2

(12) United States Patent
Ramsey et al.

(10) Patent No.: US 8,881,940 B2
(45) Date of Patent: Nov. 11, 2014

(54) CAN COVER—DISC WITH SLOTS

(75) Inventors: Christopher Paul Ramsey, Wantage (GB); Lenneke Koopmans, Enschede (NL)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 13/809,524

(22) PCT Filed: Jul. 13, 2011

(86) PCT No.: PCT/EP2011/061935

§ 371 (c)(1),
(2), (4) Date: Mar. 20, 2013

(87) PCT Pub. No.: WO2012/007496

PCT Pub. Date: Jan. 19, 2012

(65) Prior Publication Data

US 2013/0270265 A1 Oct. 17, 2013

(30) Foreign Application Priority Data

Jul. 14, 2010 (EP) ..... 10169473

(51) Int. Cl.
*B65D 51/14* (2006.01)
*B65D 51/18* (2006.01)

(52) U.S. Cl.
CPC ..... *B65D 51/14* (2013.01); *B65D 2251/0031* (2013.01); *B65D 51/18* (2013.01); *B65D 2517/0098* (2013.01)
USPC ..... 220/784; 220/257.2; 220/730

(58) Field of Classification Search
CPC ..... B65D 41/52; B65D 41/525; B65D 41/46; B65D 17/165; B65D 51/14; B65D 51/18; B65D 2517/0098
USPC ..... 220/729, 730, 716, 784, 711, 23.83, 220/257.2
See application file for complete search history.

(56) References Cited

U.S. PATENT DOCUMENTS

| | | | | |
|---|---|---|---|---|
| 2,459,558 | A * | 1/1949 | Villegas De Oribe | 220/716 |
| 2,693,685 | A * | 11/1954 | Stafford | 220/716 |
| 4,708,257 | A * | 11/1987 | Deline | 220/257.2 |
| 4,852,763 | A * | 8/1989 | Dimberio | 220/253 |
| 5,341,948 | A * | 8/1994 | Gaeta | 215/232 |
| 5,562,205 | A * | 10/1996 | Diaz | 206/151 |
| 5,887,742 | A | 3/1999 | Lewis | |
| 5,996,832 | A * | 12/1999 | Nieuwoudt | 220/257.2 |
| 6,290,084 | B1 * | 9/2001 | Louie | 220/254.4 |
| 6,321,927 | B2 * | 11/2001 | Cavella | 220/359.2 |
| 6,390,749 | B2 | 5/2002 | Song | |
| 6,588,617 | B1 | 7/2003 | Majcen et al. | |
| 8,201,385 | B2 * | 6/2012 | McLean | 53/411 |

(Continued)

FOREIGN PATENT DOCUMENTS

| | | |
|---|---|---|
| EP | 1923323 | 5/2008 |
| WO | WO 97/19001 | 5/1997 |
| WO | WO 03/062084 | 7/2003 |
| WO | WO 2009/029247 | 3/2009 |

*Primary Examiner* — Steven A. Reynolds
(74) *Attorney, Agent, or Firm* — Baker & Hostetler LLP

(57) ABSTRACT

A cover for a container, the container having a hollow body and a separate end joined together by a seam and the cover including a disc of resilient material having plurality of slots cut therein. Each slot is arranged to define a clip interspaced between two arms.

20 Claims, 5 Drawing Sheets

(56) References Cited

U.S. PATENT DOCUMENTS 8,201,706 B2 * 6/2012 Dembowiak et al. ..... 220/730
2005/0230402 A1 * 10/2005 Greenberg ..... 220/705
2006/0163266 A1 * 7/2006 De Balle Comas ..... 220/784

* cited by examiner

CAN COVER—DISC WITH SLOTS

CROSS-REFERENCE TO RELATED APPLICATIONS

This application is the National Stage of International Application No. PCT/EP2011/061935 filed Jul. 13, 2011, which claims the benefit of EP application number 10169473.5, filed Jul. 14, 2010, the disclosures of which are incorporated herein by reference in their entirety.

TECHNICAL FIELD

The present invention concerns a disc with cuts or slots, which is simple and cheap to mass-produce and may be used to cover the top of a beverage can. The cuts or slots are designed and arranged to allow the disc to be securely fastened to the double seam conventionally used to join the body and end of a beverage can together, but allow the disc to be easily removed by a user of the beverage can to gain access to the contents thereof. The cover may be used for promotional purposes and/or it may be used to prevent dust, insects etc. from gaining access to an opened beverage can.

BACKGROUND ART

Covers for beverage cans have been extensively described in the prior art both for preventing ingress of dust, insects etc. and for providing a surface suitable for promotional material or advertisements. However, none of the covers described in the prior art provide the simplicity of construction proposed by the present invention. For example:

U.S. Pat. No. 4,852,763 B (DIMBERIO DONALD J) 1 Aug. 1989 describes a protective cover for a beverage container, which cover is both removable and reusable. The cover is intended to prevent bees and other contaminating objects from entering the container after the container has been initially opened. The cover comprises a flexible, resilient disc having a notch formed therein, whereby the disc may be inserted to fit conveniently in the recessed area on the top of the beverage container and underneath the tab. The cover is rotated to align the notch with the opening in the container so that the liquid in the beverage container is accessible to the consumer. Similarly, the cover may be further rotated so that it covers the opening and thereby prevents the entry of foreign objects into the container U.S. Pat. No. 5,887,742 B (LEWIS, JIMMIE) 30 Mar. 1999 describes a "guard" for preventing insects or bugs and debris from entering an opened beverage can. The "bug guard" is secured to the top lid of the can by bending the tab actuator upward, sliding the tab actuator through a retaining slot in the "bug guard", and then bending the tab actuator downward.

U.S. Pat. No. 6,390,749 B (CONIC KOREA INC) 6 Sep. 2001 describes a cover mountable to a beverage container. The container cover is detachably mountable to an upper surface of a beverage container and comprises a body having a substantially a disc-shaped configuration. The body is partly cut away from an edge toward a centre thereof, thereby defining a beverage discharge opening. The beverage discharge opening is capable of selectively communicating with a discharging hole of the beverage container as the body is rotated. The body further has an advertisement surface such that an advertising design, letters, and so forth can be printed or an attachment can be affixed thereon.

U.S. Pat. No. 6,588,617 B (MAJCEN MARJAN ET. AL.) 8 Jul. 2003 (also published as WO 03/062084 A 31 Jul. 2003) describes a rotative closure for beverage containers, wherein a rotatable sealing plate sits atop the fixed top plate of a conventional beverage canister having a recess that corresponds with the recess of the fixed top plate in such a manner that when both recesses are aligned the user may pour out the contents contained therein. Rotating the sealing plate until the corresponding recesses are completely misaligned prevents the contents from escaping despite the orientation of the container. Furthermore, entry into the container is refused.

Finally, WO 2009/029247 A (SELIG SEALING PRODUCTS INC) 5 Mar. 2009 describes a covering substrate, which is inexpensive to manufacture and adhere to a container yet provides a hygienic environment at a top portion of the container as well as provides multiple promotional or advertising surfaces. The covering substrate is capable of being bonded to a rim of a container, the container including a top wall and the rim extending beyond the top wall defining a top portion of the container, the covering providing a hygienic environment at the top portion of the container, including a substrate, a heat seal coating laminated to the substrate and disposed for bonding the substrate to the container substantially along the perimeter of the rim, and a bondable material layered in part to the substrate opposite the heat seal coating, a portion of the bondable material defining a tab therein substantially contained within the perimeter of the substrate.

SUMMARY OF INVENTION

Accordingly, the present invention provides a cover for a container, the container having a hollow body and a separate end joined together by a seam, characterised in that the cover comprises a disc of resilient material having plurality of slots cut therein.

The slots take the form of cuts all the way through the thickness of the disc, allowing the edge of the disc (between the slot and the outer extremity of the disc) to be positioned beneath the seam holding the end and body of the finished container together.

The inventors have found that if two slots are provided on opposite sides of the disc, the slots allow the clips to be positioned beneath the seam, but the disc will tend to slide across the end (parallel to the clips) and therefore any impact may dislodge the disc. This causes the container and disc to become misaligned, which is unsightly for consumers, and subjected to more extreme abuse conditions, may even cause the discs to fall off their associated container.

The inventors have also found that the maximum number of slots is limited by the size of the end of the container. The slots are preferably located equispaced around the perimeter of the disc. If the container end is too small (for example, that used on a conventional beverage can) the slots have to be correspondingly shorter. This shorter length means that although the arms may have suitable length to allow the clips to engage beneath the seam, the arms do not allow the clips sufficient slack to fold flat against the body of the container. This results in the disc being more easily dislodged from the end of the container.

Ideally, for application on containers having a smaller diameter (for example, a conventional beverage can or small food can), the disc has three slots to prevent the sliding mentioned above (with respect to two slots) and also to provide slots, which have long enough arms to allow the clips to fold flat against the body of the container.

However, for use on larger diameter containers (for example kegs or conventional food cans), the inventors have found that four or more slots may be provided, each slot being sufficiently long to provide long enough arms to allow the clips to engage below the seam, whilst folding flat against the surface of the body, which lies adjacent to the end.

BRIEF DESCRIPTION OF DRAWINGS

The present invention will now be described, by way of example only, with reference to the accompanying drawings, in which:

Referring to FIG. 1, a cover disc 10 according a preferred embodiment of the invention has three equispaced slots 15 disposed within its outer perimeter 25. Each slot is shaped to define a clip 20 interspaced between a pair of arms 30, such that the clip 20 and the pair of arms are disposed between the slot 15 and the outer perimeter 25.

FIG. 2 is an isometric view of a beverage can 1 supporting the cover disc 10 as shown FIG. 1. The arms 30 of the slot 15 are adapted to be of sufficient length to position the clip 20 section of each slot 15 below the seam 5 joining the body and end of the beverage can 1 together.

FIG. 3 illustrates a cover disc 10 with two slots 15 cut therein, each having a clip 20 interspaced between two arms 30.

FIG. 4 is side view showing the cover disc 10 according to FIG. 3, fixed to a beverage can 1. The inventors have found that if the cover disc 10 is provided with only two slots 15 on opposite sides of the disc 10, the two slots 15 are parallel and the cover disc 10 tends to slide relative to the end of the beverage can 1. Thus, the cover disc 10 may become dislodged or misaligned during normal shelf stacking.

Figure 3:
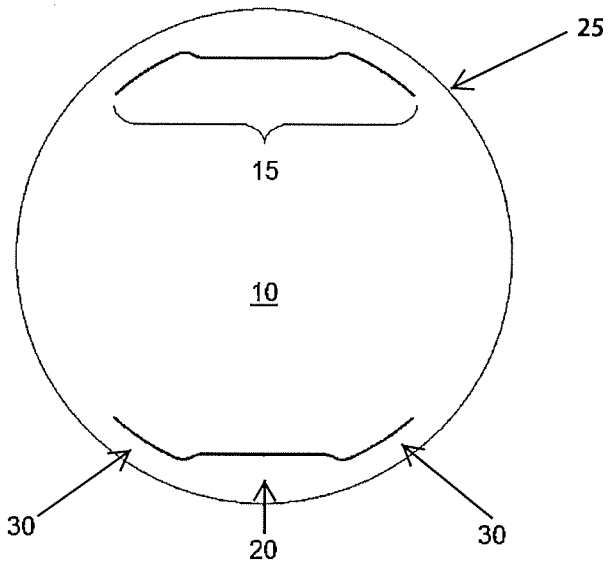
FIG. 3 is a plan view of a cover disc, having two equispaced slots.
Figure 4:
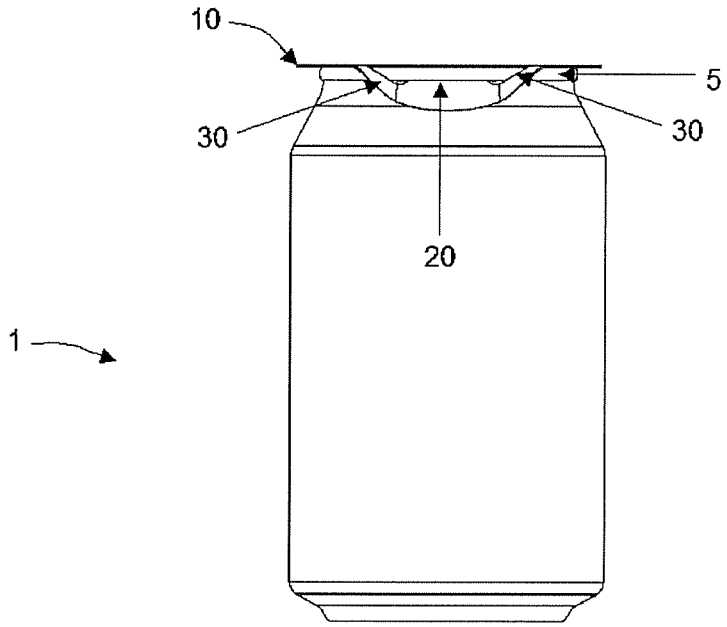
FIG. 4 is a side view of a beverage can with the cover disc illustrated in FIG. 3.

However, when the cover disc 10 is provided with two slots 15 (FIG. 4) or three slots 15 (FIG. 3) the inventors have noted that the arms 30 are of sufficient length to allow the clips 20 to both lie beneath the seam 5 and provide just sufficient tension that the clip 20 lies flat against the side wall of the body (not referenced) of the beverage can 1.

Figure 5:
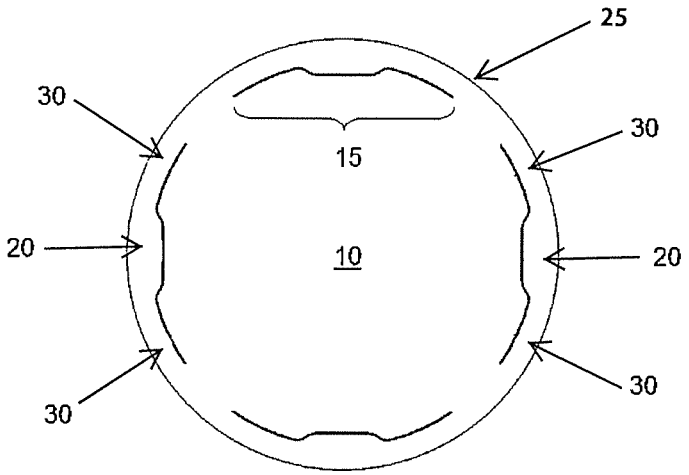
FIG. 5 is a plan view of a cover disc, having four equispaced slots.

FIG. 5 is a plan view of the cover disc 10 with four slots 15 cut therein, each having a clip 20 interspaced between two arms 30. The inventors have found that if four or more slots 15 are provided the length of the arms 30 may be restricted by the size of the cover disc 10.

Figure 6:
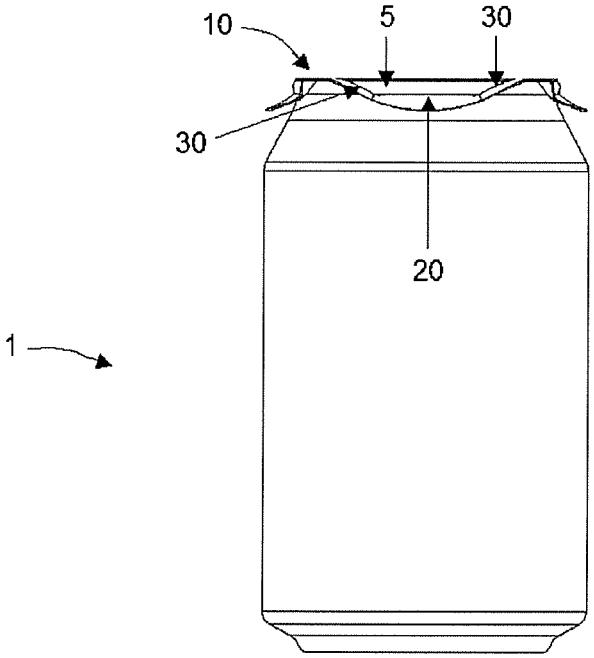
FIG. 6 is a side view of a beverage can with the cover disc illustrated in FIG. 5.

FIG. 6 shows the cover disc 10 having four slots 15, fixed to a conventional beverage can 1. Although the arms 30 are of sufficient length to allow the clips 20 to lie beneath the seam 5, the clip 20 protrudes tangentially from the beverage can 1. This results in the cover disc 10 being less well secured to the beverage can 1 and raises the likelihood of the cover disc 10 being dislodged from the beverage can 1, when a plurality of cans is displayed together.

Figure 1:
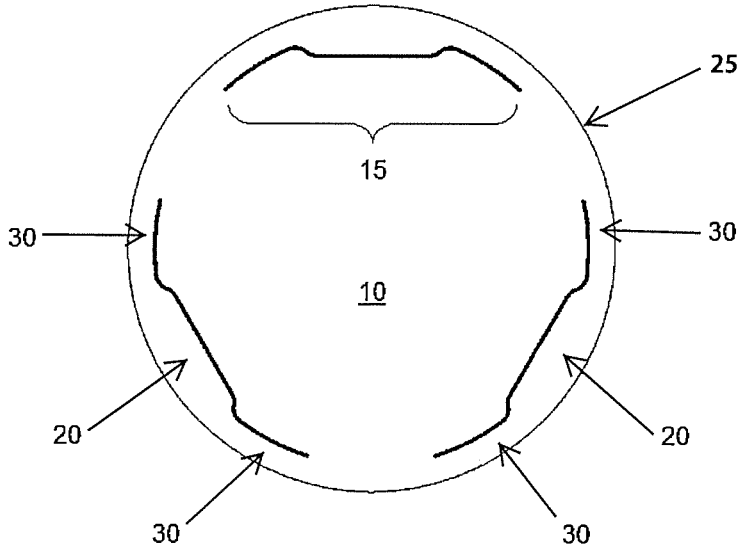
FIG. 1 is a plan view of a cover disc according a preferred embodiment of the invention having three equispaced slots.
Figure 2:
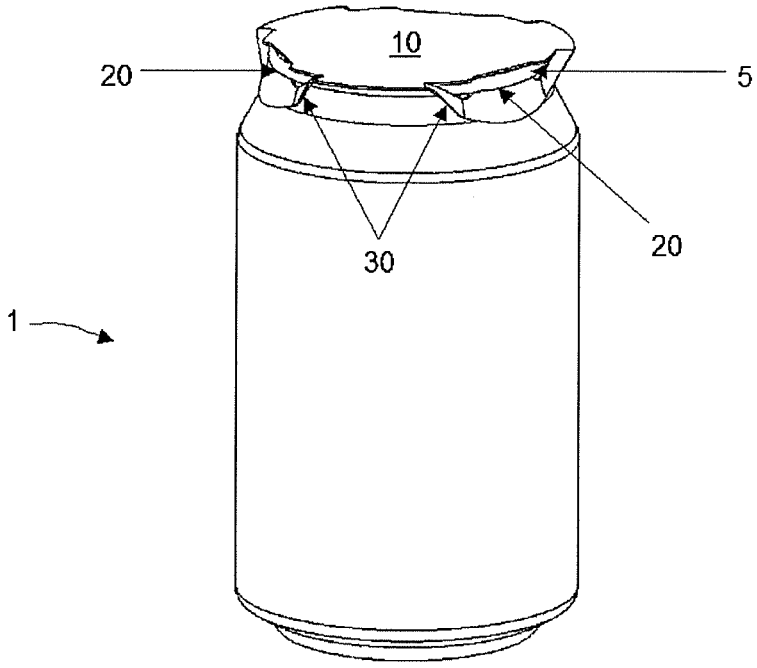
FIG. 2 is an isometric view of a beverage can with the cover disc illustrated in FIG. 1 fitted over the end of the can.
Figure 7:
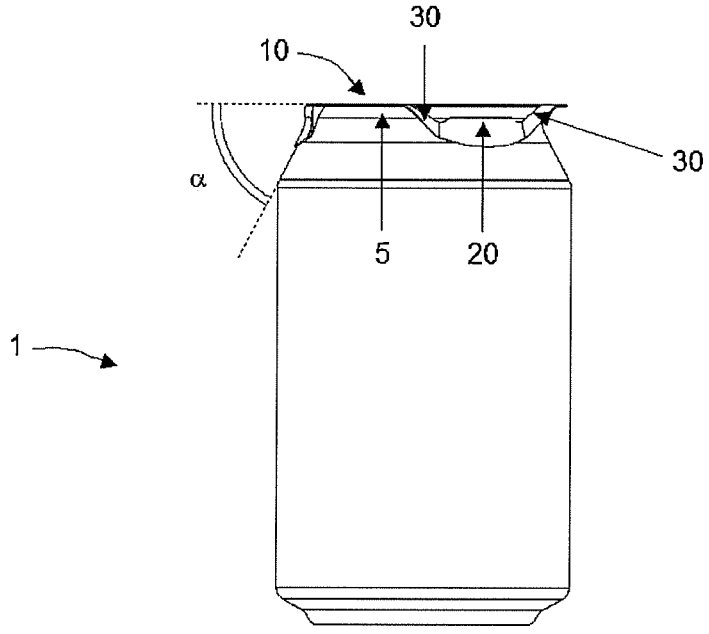
FIG. 7 is a side view of a beverage can with a cover disc having a preferred number of slots with the clips engaged beneath the seam and folded flat against the adjacent body of the beverage can.

Ideally the cover disc 10 for a conventional beverage can comprises 3 slots, as illustrated in FIGS. 1 and 2. During manufacture, the upper edge of the body of a beverage can is necked in to allow it to be seamed to a smaller diameter end. This configuration is clearly shown in FIG. 7, where the side-wall of the body (not referenced) joins the end at an angle $\alpha$. For this reason, the "slack" in the arms 30 of the cover disc 10 only needs to be sufficient to allow the clip 20 to fold at angle $\alpha$ and thus lie flat against the body of the beverage can 1.

Figure 8:
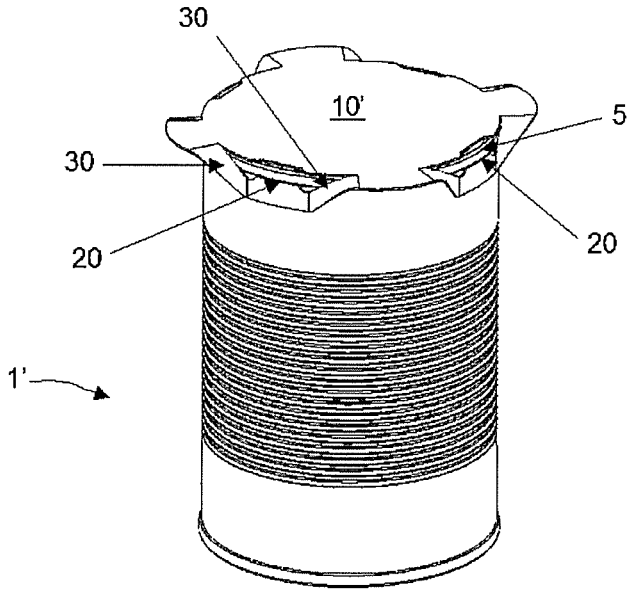
FIG. 8 is an isometric view of a conventional, larger diameter food can supporting a squared disc having four slots.

FIG. 8, shows a cover disc 10' connected to a conventional food can 1', which normally has straight sided side-walls (not referenced). The greater diameter of the food can 1 and consequential increased dimensions of the cover disc 10' allows four slots to be provided on the cover disc 10'. The arms 30 of the slots 15 have to be longer to allow the clips 20 both to clip below the seam 5 and allow sufficient slack for the clips 20 to lie flat against the body of the food can 1'.

Figure 9:
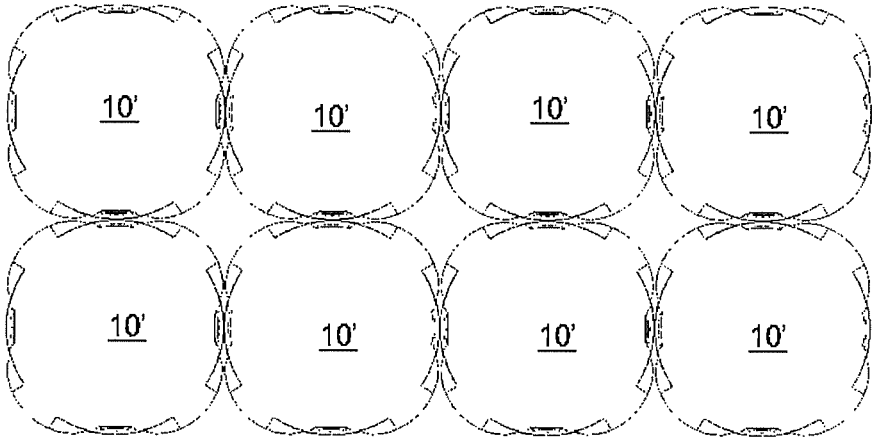
FIG. 9 is a plan view of multiple cans arranged in two rows of four cans each.

As illustrated in FIG. 9, the cover discs 10' may also have a slightly squared shape and the inventors have found that food cans 1', to which the cover discs 10' have been applied may also be stacked side by side without the cover discs 10' becoming dislodged and/or interfering with neighbouring cans. This is also true where a plurality of food cans 1' is packaged in a multipack, provided the cover discs 10' lie within the footprint of the food cans 1' contained within the multipack.

The cover discs may be hand assembled on the container by simply clipping the disc over the can seam by simple axial movement. Alternatively, the cover disc may be assembled on the container automatically after the cans have been filled. The cover discs could be fitted by the consumer and re-used or supplied on each can. Furthermore, the cover disc may be supplied as part of the cardboard outer used on multi-packs and marked out so that the user may press out the covers disc before applying it to a container.

To check performance, the inventors have manufactured discs from various materials (including plastics and waxed card) and checked that the assembly and removal of the discs is acceptable. The preferred materials used to manufacture the cover discs are currently 0.2-1.0 mm thick polystyrene sheet or waxed card. Preferably, 0.5 mm thick polystyrene or waxed card is used.

The invention claimed is:

1. A cover for a container, the container having a hollow body and a separate end joined together by a seam, the cover comprising:

a disc having an outer perimeter disposed about a central axis, the disc including a plurality of slots cut therein, each of the slots defining a clip disposed between the slot and the outer perimeter and configured to clip to an underside of the seam of the container, each of the slots further defining a pair of arms disposed between the slot and the outer perimeter and on either side of the clip, wherein the clip is disposed radially inward of the pair of arms in relation to the central axis and the outer perimeter.

2. A cover for a container according to claim 1, wherein the plurality of slots are equispaced around the perimeter of the disc.

3. A cover for a container according to claim 1, wherein when applied to a container, the clip defined by each of the slots is adapted to lie substantially flush to the container body.

4. A cover for a container according to claim 1, wherein the cover has more than two slots.

5. A cover for a container according to claim 1, wherein the disc is planar.

6. A cover for a container according to claim 1, wherein the disc is 0.2 to 1.0 mm thick.

7. A cover for a container according to claim 6, wherein the disc is 0.5 mm thick.

8. A cover for a container according to claim 1, wherein the cover is printed with an advertisement or promotional material.

9. A cover for a container according to claim 1, wherein the cover is adapted to be fixed over the container end by simple axial movement of the clips.

10. The cover for a container according to claim 1, wherein the cover is adapted to fit one of a beverage can, a food can, and a keg.

11. The cover for a container according to claim 1, wherein the disc is formed of a resilient material.

12. A cover for a container according to claim 11, wherein the cover is made from a material comprising a plastics material.

13. A cover for a container according to claim 11, wherein the cover is made from a material comprising cardboard.

14. The cover for a container according to claim 1, wherein each of the clips defined by each of the slots, respectively, include a linear cut edge that is configured to clip to an underside of the seam of the container.

15. The cover for a container according to claim 1, wherein the outer perimeter is continuous about the central axis and the entirety of the outer perimeter is disposed radially outward in relation to each of the slots.

16. A multi-pack outer package having multiple containers, each one of the containers having a hollow body and a separate end joined together by a seam, the package comprising a cover for each container, each cover comprising a disc having an outer perimeter disposed about a central axis, the disc including a plurality of slots cut therein, each of the slots defining a clip disposed between the slot and the outer perimeter and configured to clip to an underside of the seam of the container, each of the slots further defining a pair of arms disposed between the slot and the outer perimeter and on either side of the clip, wherein the clip is disposed radially inward of the pair of arms in relation to the central axis and the outer perimeter.

17. The multi-pack outer package of claim 16 wherein the containers include one of food containers and beverage containers.

18. The multi-pack outer package of claim 16, wherein each disc is formed of a resilient material.

19. The multi-pack outer package of claim 18 wherein the covers are formed of a material comprising cardboard.

20. The multi-pack outer package of claim 18 wherein the covers have markings thereon.

* * * * *